US009376840B2

(12) United States Patent
Lankford

(10) Patent No.: US 9,376,840 B2
(45) Date of Patent: Jun. 28, 2016

(54) T-POST GATE KEEPER

(71) Applicant: Mark Lankford, Tyler, TX (US)

(72) Inventor: Mark Lankford, Tyler, TX (US)

( * ) Notice: Subject to any disclaimer, the term of this patent is extended or adjusted under 35 U.S.C. 154(b) by 198 days.

(21) Appl. No.: 13/948,601

(22) Filed: Jul. 23, 2013

(65) Prior Publication Data

US 2015/0028604 A1 Jan. 29, 2015

(51) Int. Cl.

| | |
|---|---|
| ***E05B 15/02*** | (2006.01) |
| ***E05B 65/00*** | (2006.01) |
| ***E05B 63/00*** | (2006.01) |
| ***E05C 19/10*** | (2006.01) |

(52) U.S. Cl.

CPC ..... *E05B 65/0007* (2013.01); *E05B 63/0056* (2013.01); *E05C 19/10* (2013.01); *Y10T 292/707* (2015.04)

(58) Field of Classification Search

USPC ..... 292/341.19, 341.18, 340, DIG. 13, 292/DIG. 29

See application file for complete search history.

(56) References Cited

U.S. PATENT DOCUMENTS

| | | | | |
|---|---|---|---|---|
| 2,074,759 | A * | 3/1937 | Richards | E05B 65/0007 292/213 |
| 3,907,345 | A * | 9/1975 | Martini | E05C 5/00 292/68 |
| 5,375,815 | A * | 12/1994 | Akins | A01K 3/00 256/24 |
| 5,518,333 | A | 5/1996 | Cienkus, Jr. et al. | |
| 5,964,548 | A * | 10/1999 | Akins et al. | 403/398 |
| 6,619,627 | B2 | 9/2003 | Salisbury et al. | |
| 8,544,149 | B1 * | 10/2013 | Faber | E05D 7/12 16/256 |
| 2012/0261634 | A1 | 10/2012 | Graves | |

* cited by examiner

*Primary Examiner* — Mark Williams
(74) *Attorney, Agent, or Firm* — Smith IP Services, P.C.

(57) ABSTRACT

A gate keeper is provided for attachment of a gate latch to a T-post. In an embodiment, a gate keeper comprises a connector and a gate latch. The gate latch is constructed of a rigid length of material having a latching region, a base region, an extending region, and a u-shaped region. The latching region extends approximately perpendicular to the base region in a first plane. The base region extends approximately perpendicular to the extending region in the first plane. The extending region extends approximately perpendicular with the u-shaped region in a second plane. The connector circumposes the T-post, between a pair of studs. The height of the connector is adjusted by arrangement of the connector between differing pair of studs along the T-post. The gate latch axially rotates about the base region, allowing the u-shaped region to secure a gate rail attached to a movable gate.

5 Claims, 13 Drawing Sheets

FIG. 13
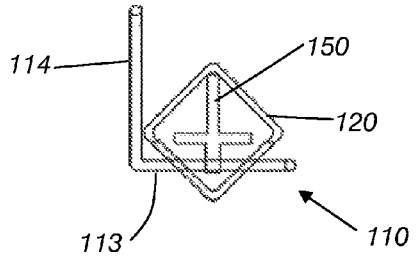
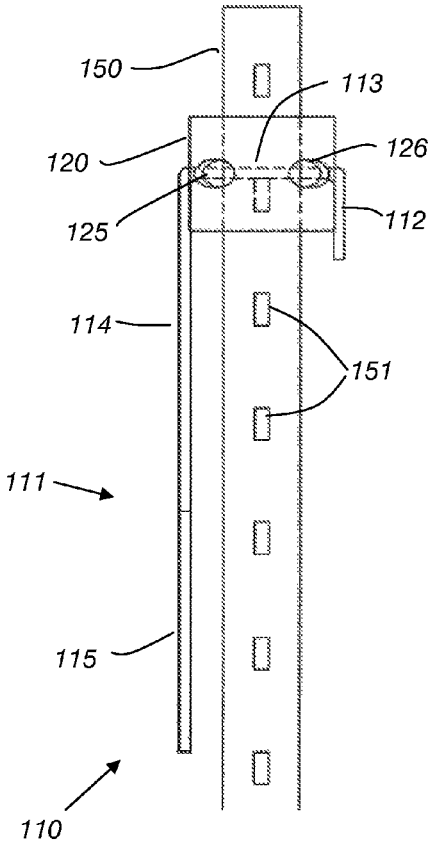
FIG. 14
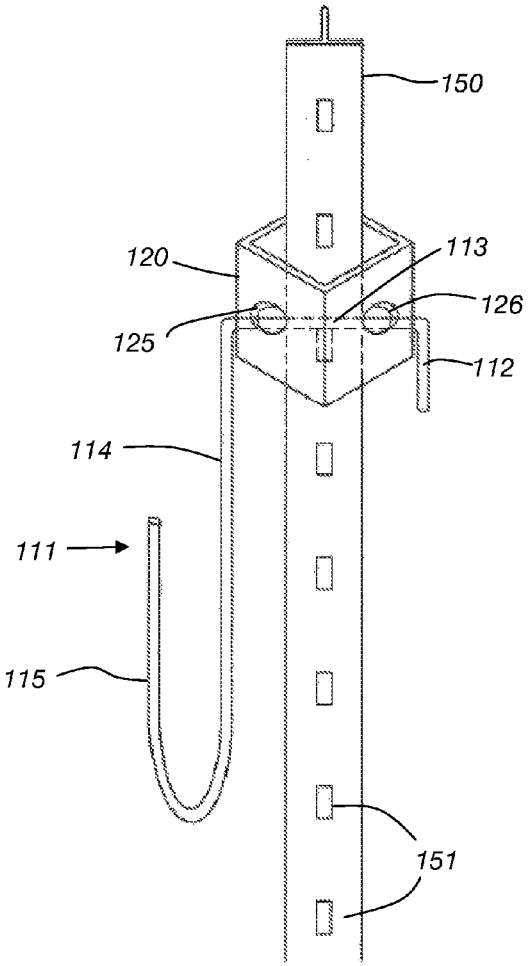
FIG. 15

T-POST GATE KEEPER

BACKGROUND

The present invention relates to connectors attached to post members, and more particularly to a gate latch assembly connected to a studded T-post.

T-posts have generally been available as fence posts, signs posts, or to fence in areas of land. Studded T-posts have a T-shaped cross-section, with one or more studs spaced along an outer surface of the T-post. The studs attached to the T-posts allow wire or other surfaces to be attached to the T-posts and prevent such wire or surfaces from slipping from the T-post. The uniform spacing of the studs allows the attachments to be attached to such T-posts at various heights relative to the ground.

Some assemblies are known to the art which permit height adjustment by seating on a stud of the T-post. For example, U.S. Pat. No. 5,518,333 pertains to a connector for a studded T-post having an internal connector.

U.S. Pat. No. 6,619,627 discloses a fence bracket for mounting a variety of items by use of u-hooks, plates or brackets to a T-post without the use of tools.

However, the above references suffer from one or more disadvantages. The references either require insertion and removal of an internal connector or other attachment (such as a pin, a plastic tie, nuts and bolts, etc . . . ) for height adjustment along the T-Post or do not provide an adequate gate latching system. Accordingly, a need exists for securing a freely rotating gate latch to a T-post by a height-adjustable connector.

SUMMARY

In accordance with embodiments of the current invention, a gate keeper is provided for attachment of a gate latch to a T-post. The gate latch is secured to the T-post by a connector, and is capable of rotation with respect to the connector. The gate latch secures a gate rail attached to a movable gate. Rotation of the gate latch with respect to the connector allows the gate latch to secure differing sizes of gate rails. The connector fits between studs of the T-post. Changing the position of the connector between differing studs allows for height adjustment of the T-post gate keeper with respect to the ground.

In a first embodiment, a gate keeper comprises a connector and a gate latch. The gate latch is constructed of a rigid length of material having a latching region, a base region, an extending region, and a u-shaped region. The latching region extends approximately perpendicular to the base region in a first plane. The base region extends approximately perpendicular to the extending region in the first plane. The extending region extends approximately perpendicular with the u-shaped region in a second plane. The connector in the embodiment comprises a first and second spring. One end of each spring attaches to either end of the base region. An opposing end of each spring are attached to each other circumposing the T-post, between a pair of studs. The height of the connector is adjusted by pulling on the springs such that they have enough slack to move in between a different pair of studs along the T-post, thereby allowing adjustment without removal or re-insertion of an external piece. The gate latch is secured against the T-post at the base region and rests between two studs of the T-post. The gate latch axially rotates about the base region, allowing the u-shaped region to secure a gate rail attached to a movable gate.

In a second embodiment, the gate latch is similar to that of the first embodiment. The connector is a square shaped bracket piece, with a pair of external apertures along a front surface of the connector. The connector is inserted over the T-post at a specific height. The gate latch is inserted through the apertures, securing the connector between a pair of studs. The gate latch is capable of axial rotation with respect to the connector.

BRIEF DESCRIPTION OF THE DRAWINGS

A complete understanding of the present invention may be obtained by reference to the accompanying drawings, when considered in conjunction with the subsequent, detailed description, in which:

FIG. 13 shows a top view of the gate keeper, according to the embodiment of FIG. 12.

FIG. 14 shows a front view of the gate keeper of the embodiment of FIG. 12.

FIG. 15 shows a front perspective view of the gate keeper of the embodiment of FIG. 12.

DETAILED DESCRIPTION

Figure 1:
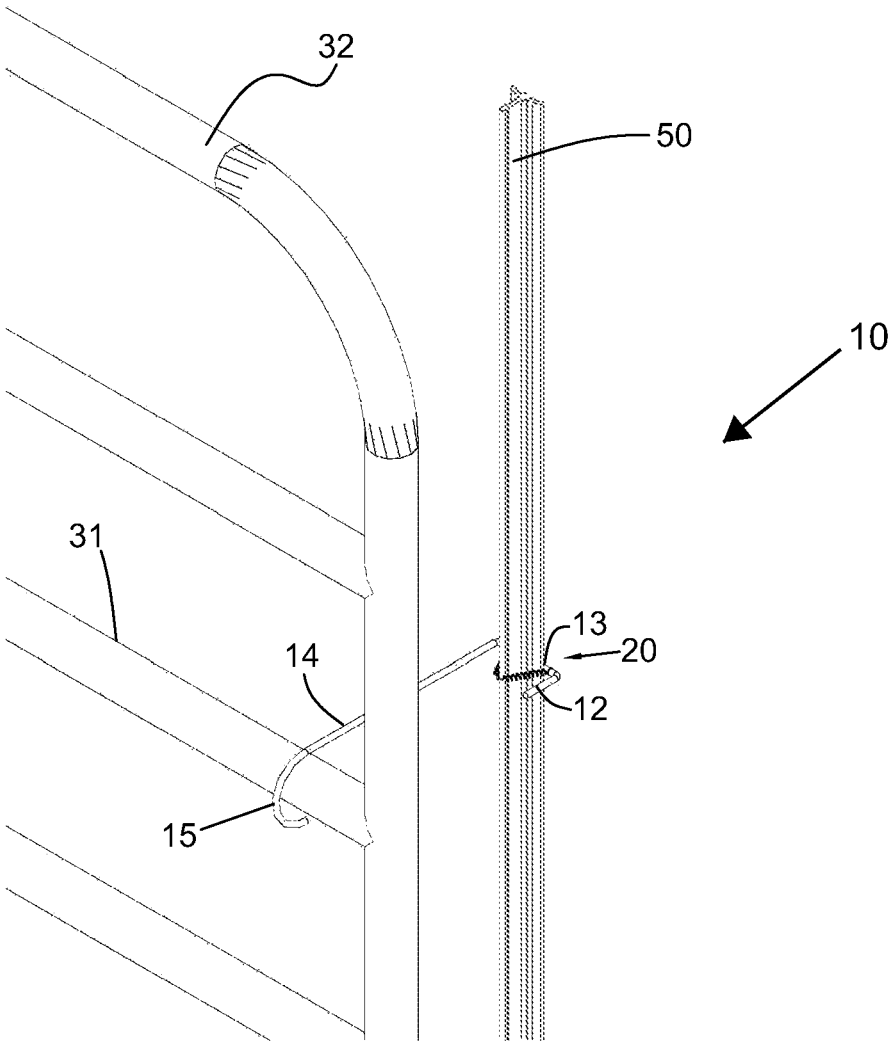
FIG. 1 shows a perspective view of a gate keeper illustrating the gate latch securing a gate, according to an embodiment of the invention.

According to an exemplary preferred embodiment of the invention, a gate keeper 10 comprises a gate latch 11 and a connector 20, as shown in FIGS. 1-11. The gate latch 11 is constructed of a rigid piece of elongate metal bent such that the gate latch 11 has a latching region 12, a base region 13, an extending region 14, and a u-shaped region 15.

Figure 10:
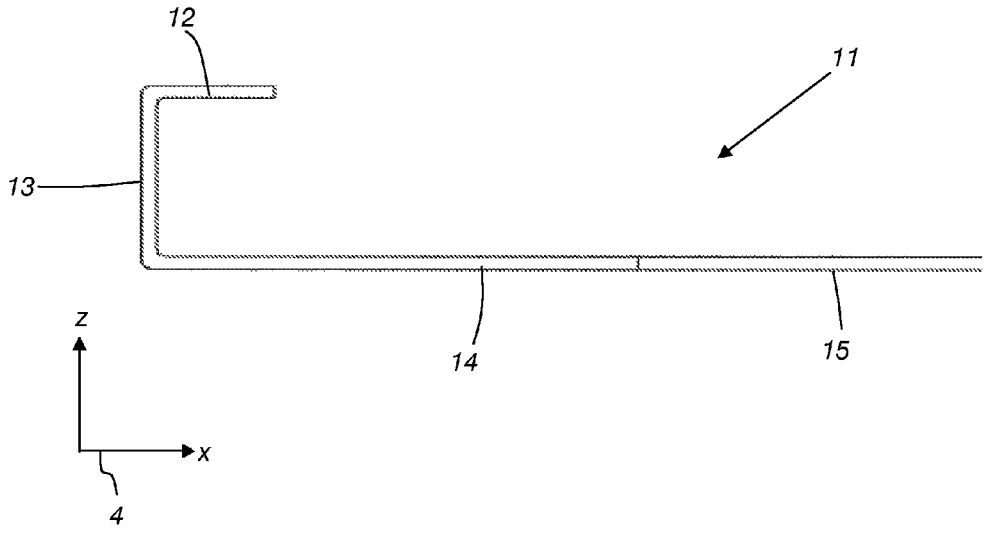
FIG. 10 shows a top view of the gate latch of the embodiment of FIG. 1.

In accordance with FIG. 10, the latch region 12, base region 13, and extending region extend complanar in a first plane 4. The latching region 12 extends approximately 90° to the base region 13, as shown in FIG. 10. The base region 13 extends approximately 90° to the extending region 14, as shown in FIG. 10.

Figure 11:
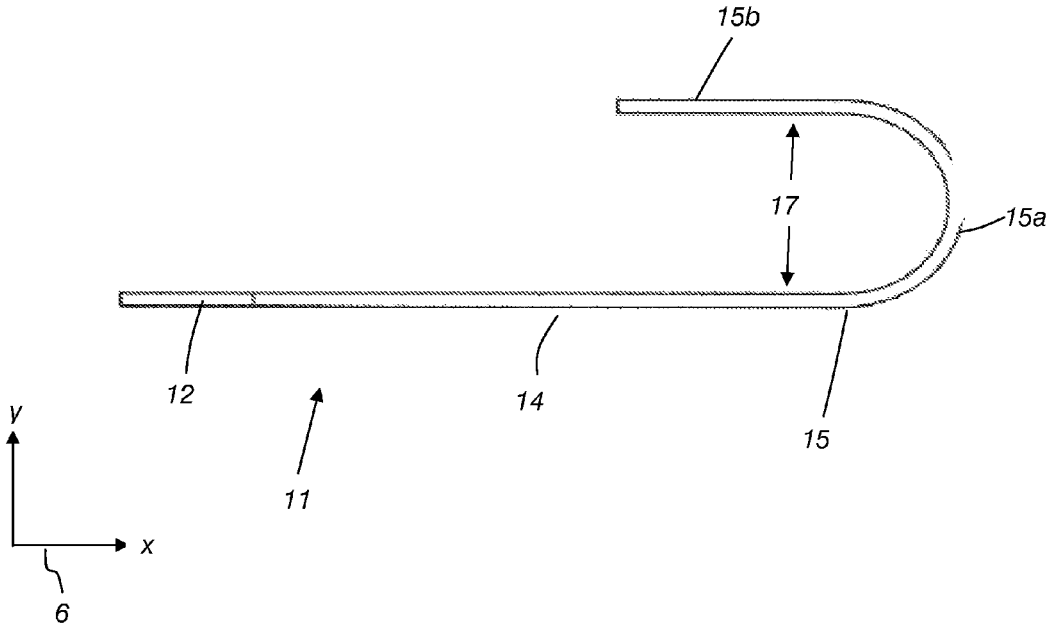
FIG. 11 shows a side view of the gate latch of the embodiment of FIG. 1.
Figure 12:
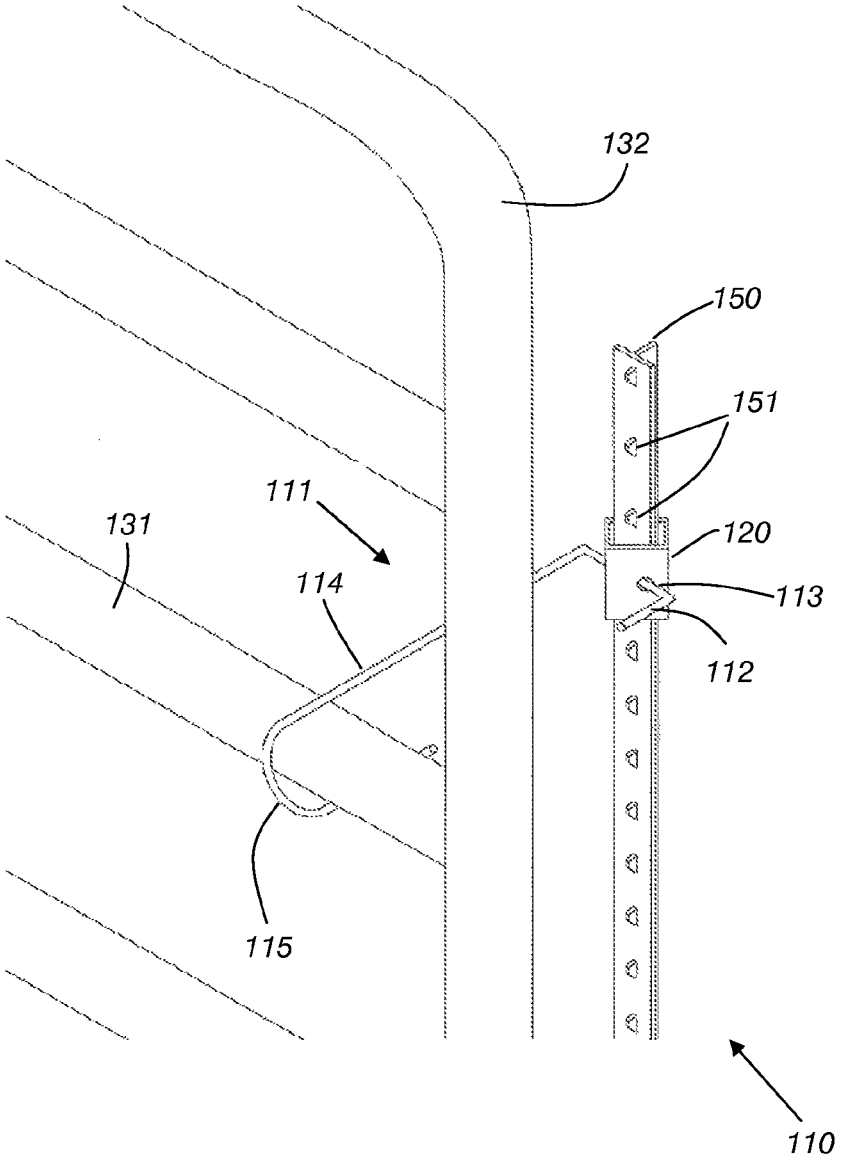
FIG. 12 shows a perspective view of a gate keeper illustrating the gate latch securing a gate, according to an alternate embodiment of the invention.

In accordance with FIG. 11, the u-shaped region 15 extends in a second plane 6. The extending region 14 extends approximately 90° to the u-shaped region 15, as shown in FIG. 11. The u-shaped region has a curvilinear surface 15*a* extending into a lengthwise surface 15*b*. The lengthwise surface 15*b* extends approximately parallel with the extending region 14 at a distance 17 which is approximately greater than a diameter of a gate rail 32 attached to a gate 31.

Figure 8:
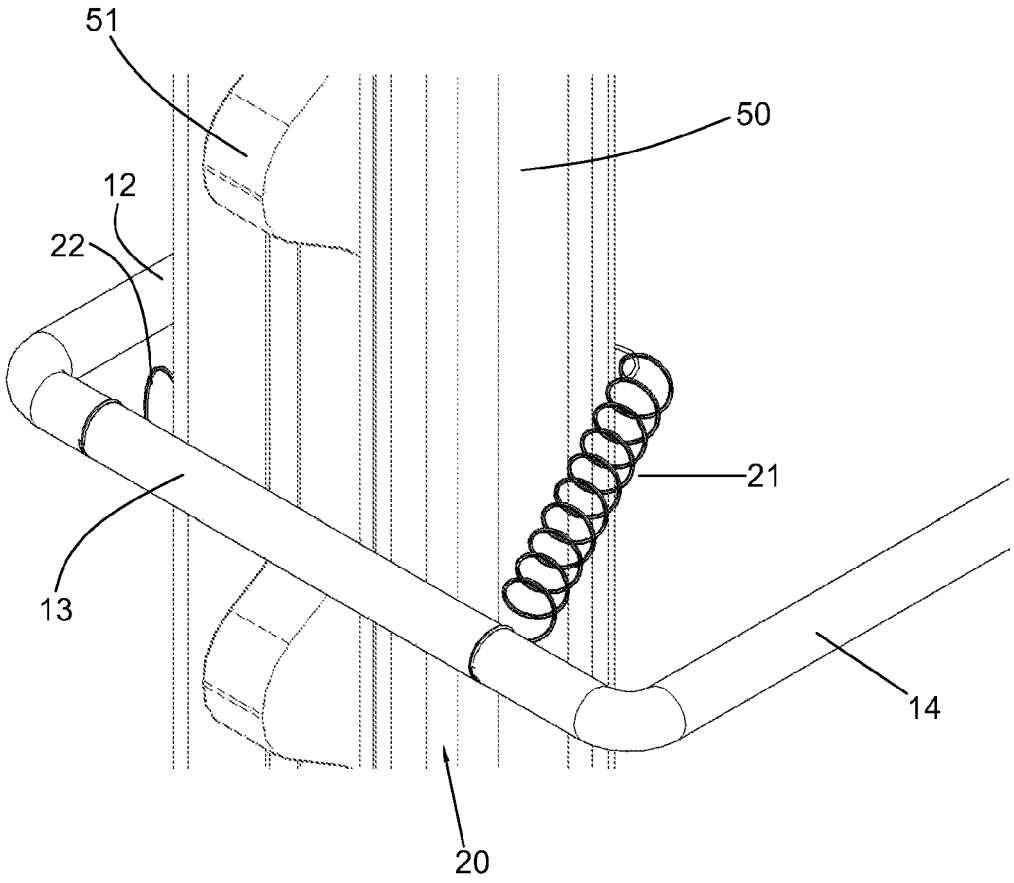
FIG. 8 shows a front perspective view illustrating the connector attached to a T-post by a pair of springs, according to the embodiment of FIG. 1.
Figure 9:
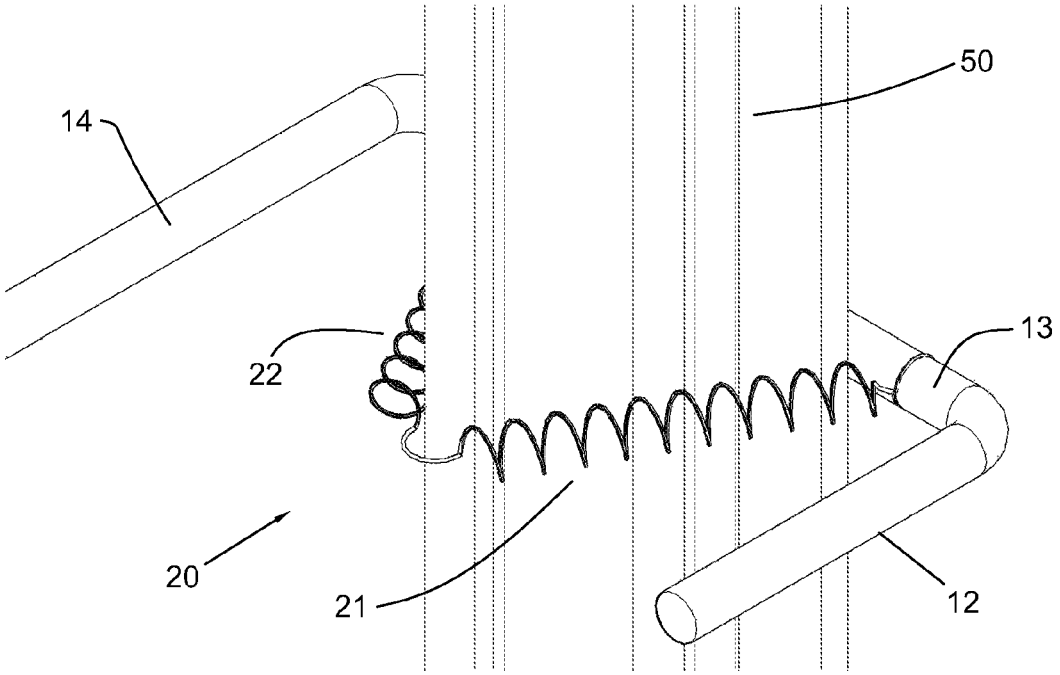
FIG. 9 shows a rear perspective view illustrating the connector attached to a T-post by a pair of springs, according to the embodiment of FIG. 1.

In accordance with FIGS. 2-9, the connector 20 in the embodiment further comprises a first and second spring, 21, 22. One end of each spring 21, 22 attaches to either end of the base region 13. An opposing end of each spring 21, 22 attaches to each other. The springs 21, 22 are arranged such that they circumpose a T-post 50, between a pair of studs 51, as shown in FIGS. 8-9. The height of the connector 20 is adjusted by decompressing on the springs 21, 22 allowing movement of the connector 20 in between a different pair of studs 51 along the T-post 50.

Figure 2:
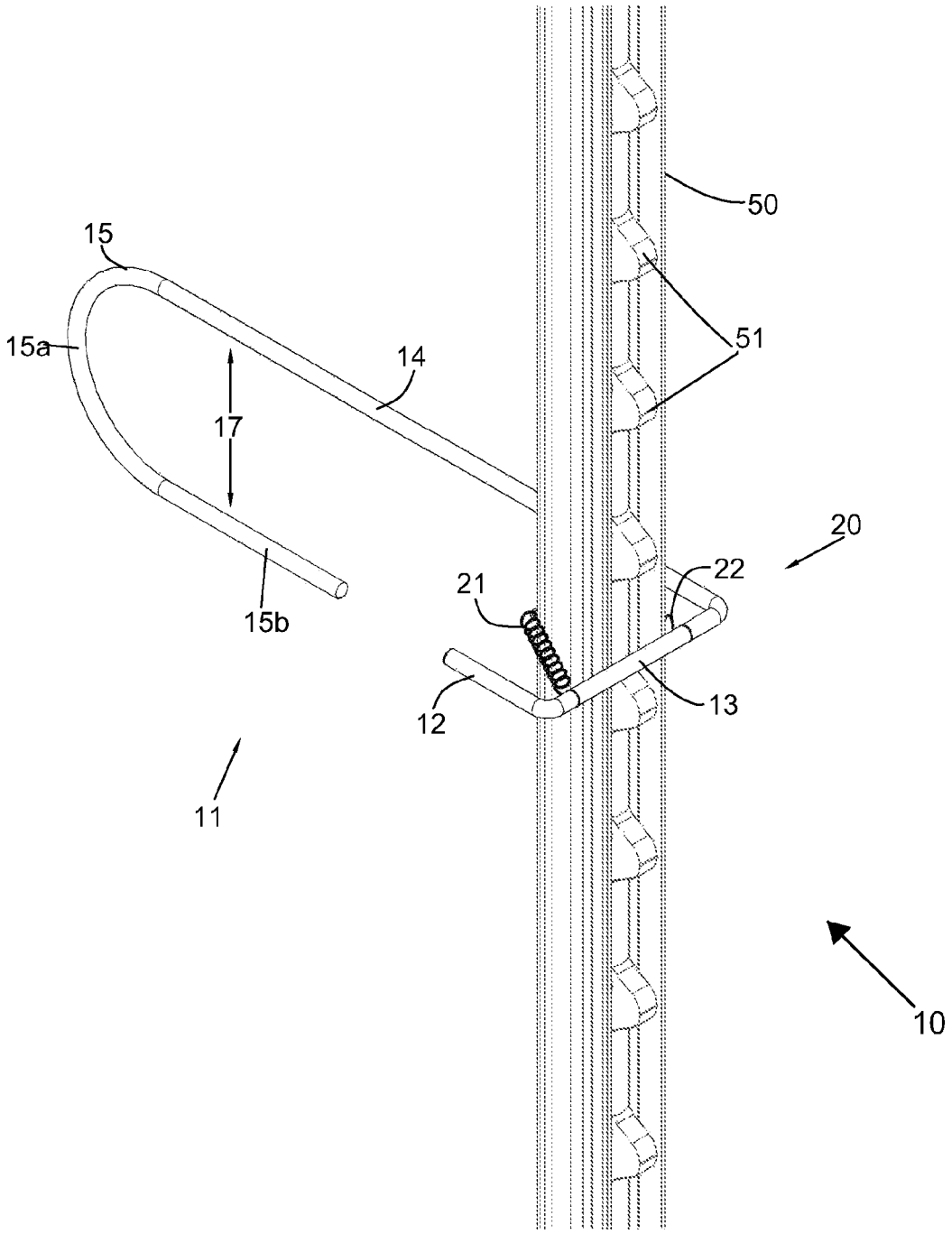
FIG. 2 shows a perspective view of a gate keeper illustrating a gate latch attached to a connector, according to the embodiment of FIG. 1.
Figure 3:
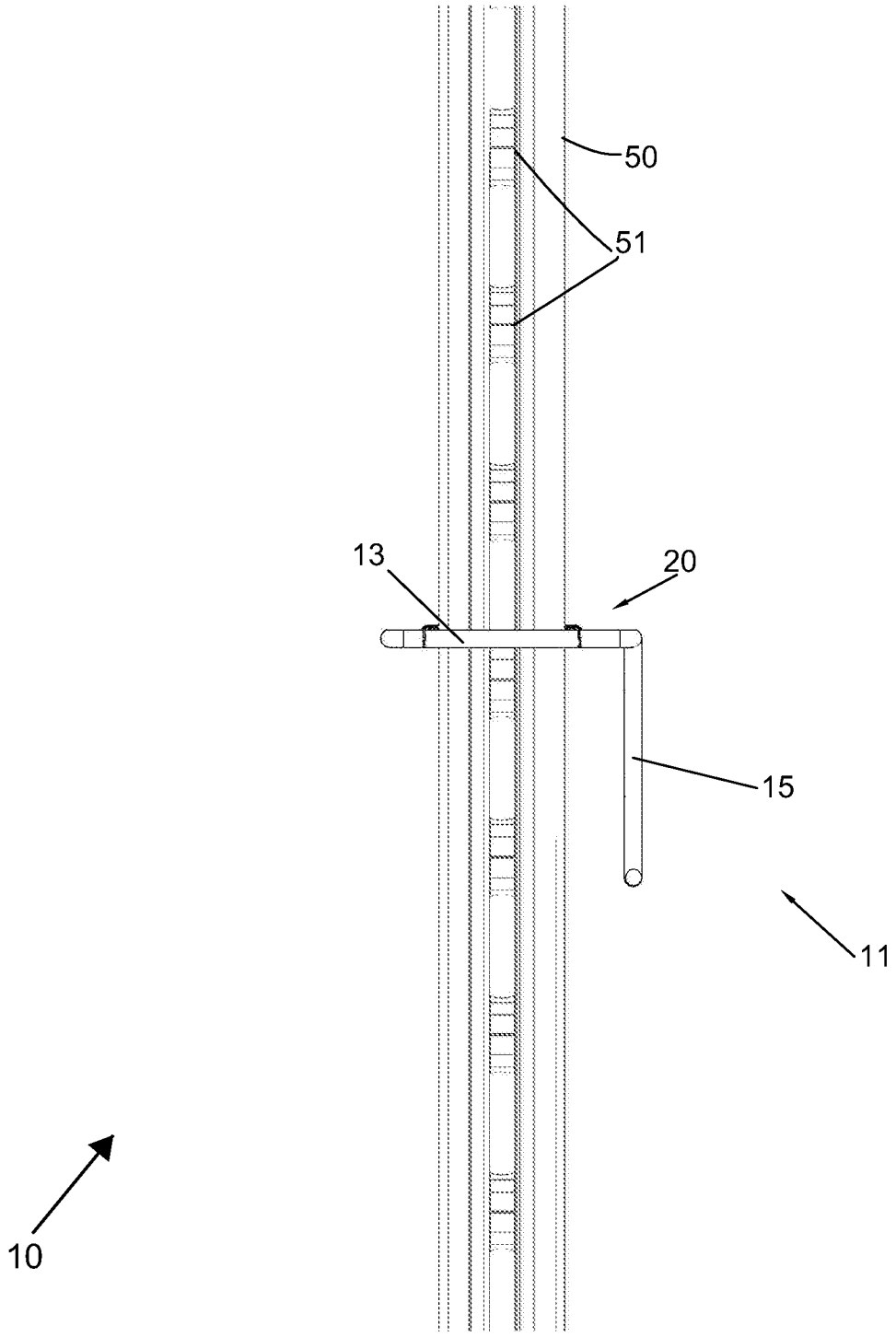
FIG. 3 shows a front view of the gate keeper of the embodiment of FIG. 1.
Figure 4:
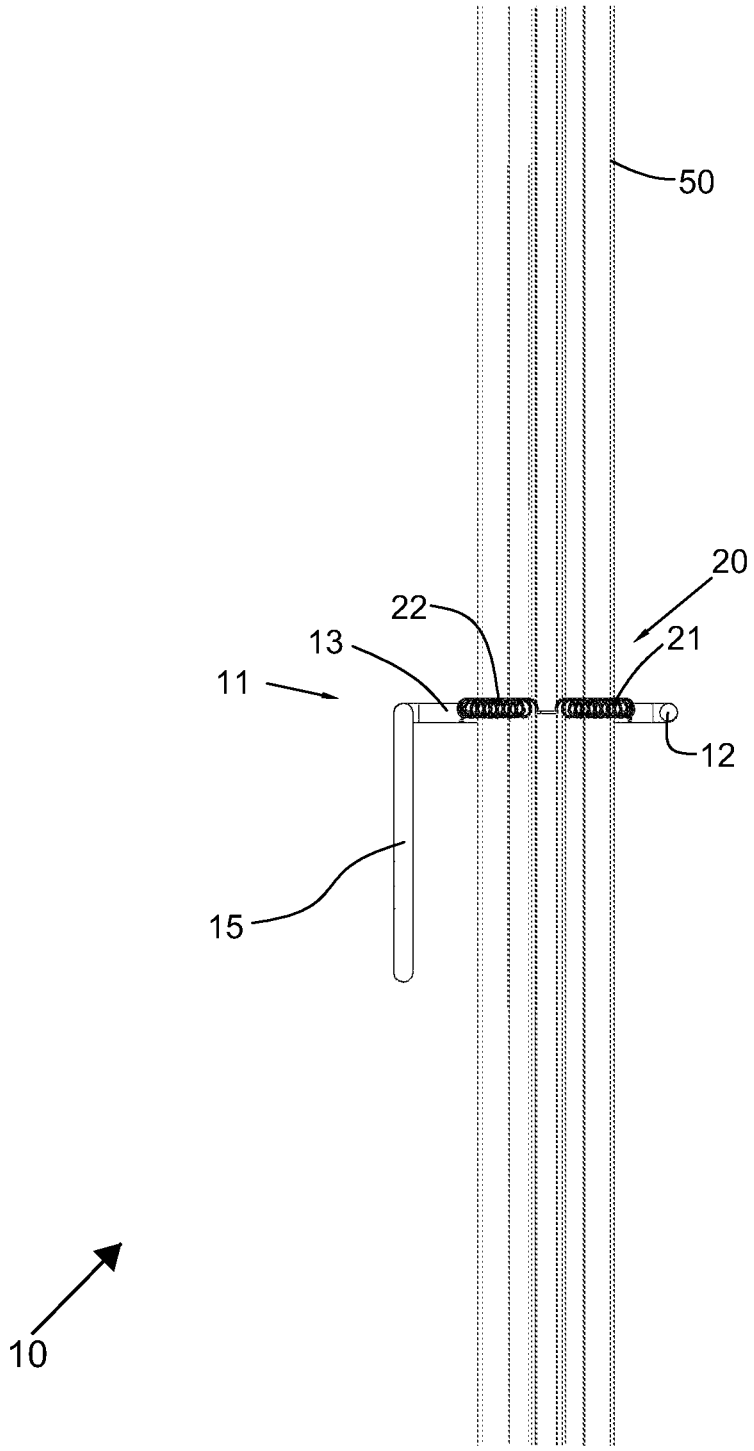
FIG. 4 shows a back view of the gate keeper of the embodiment of FIG. 1.
Figure 5:
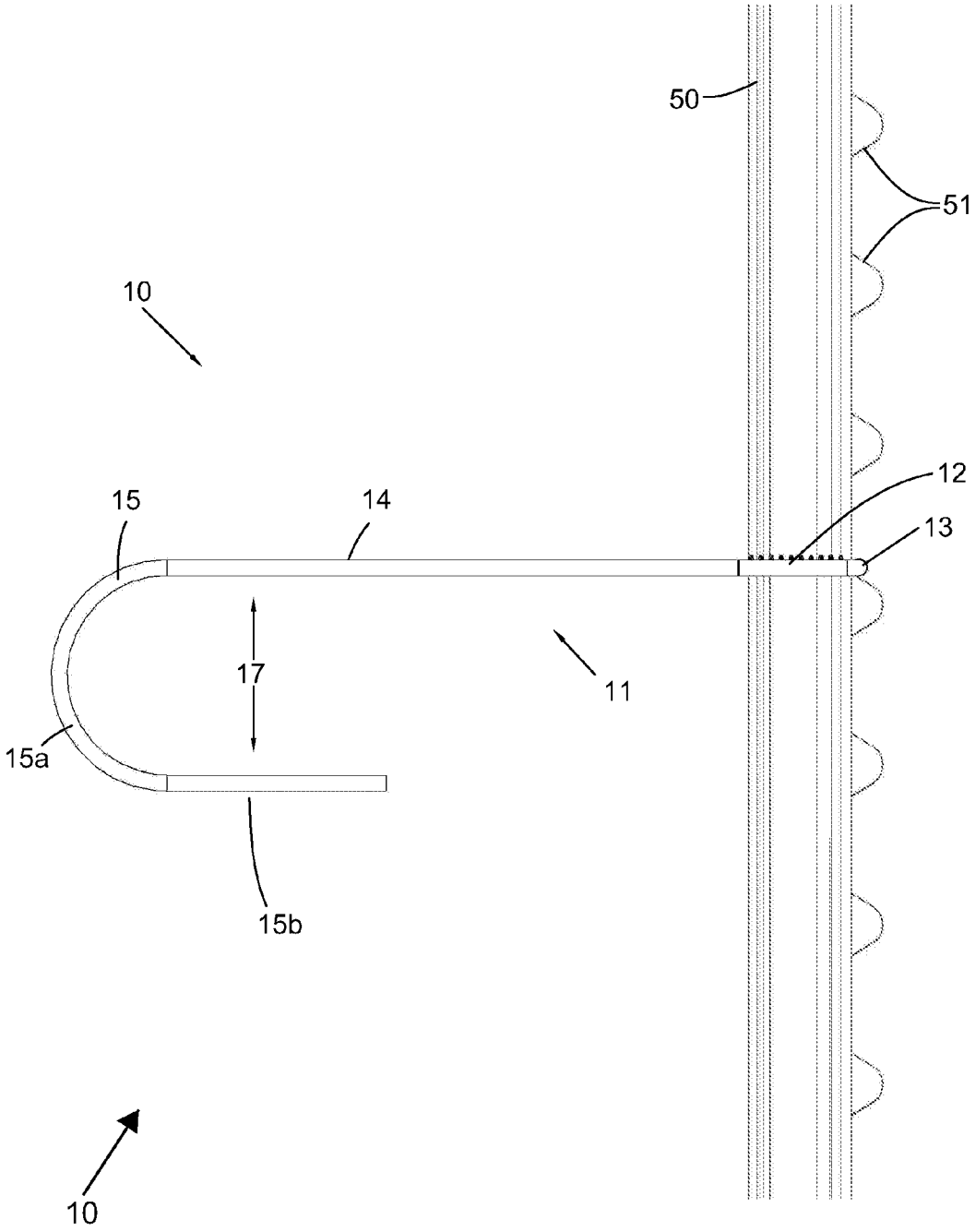
FIG. 5 shows a side view of the gate keeper of the embodiment of FIG. 1.
Figure 6:
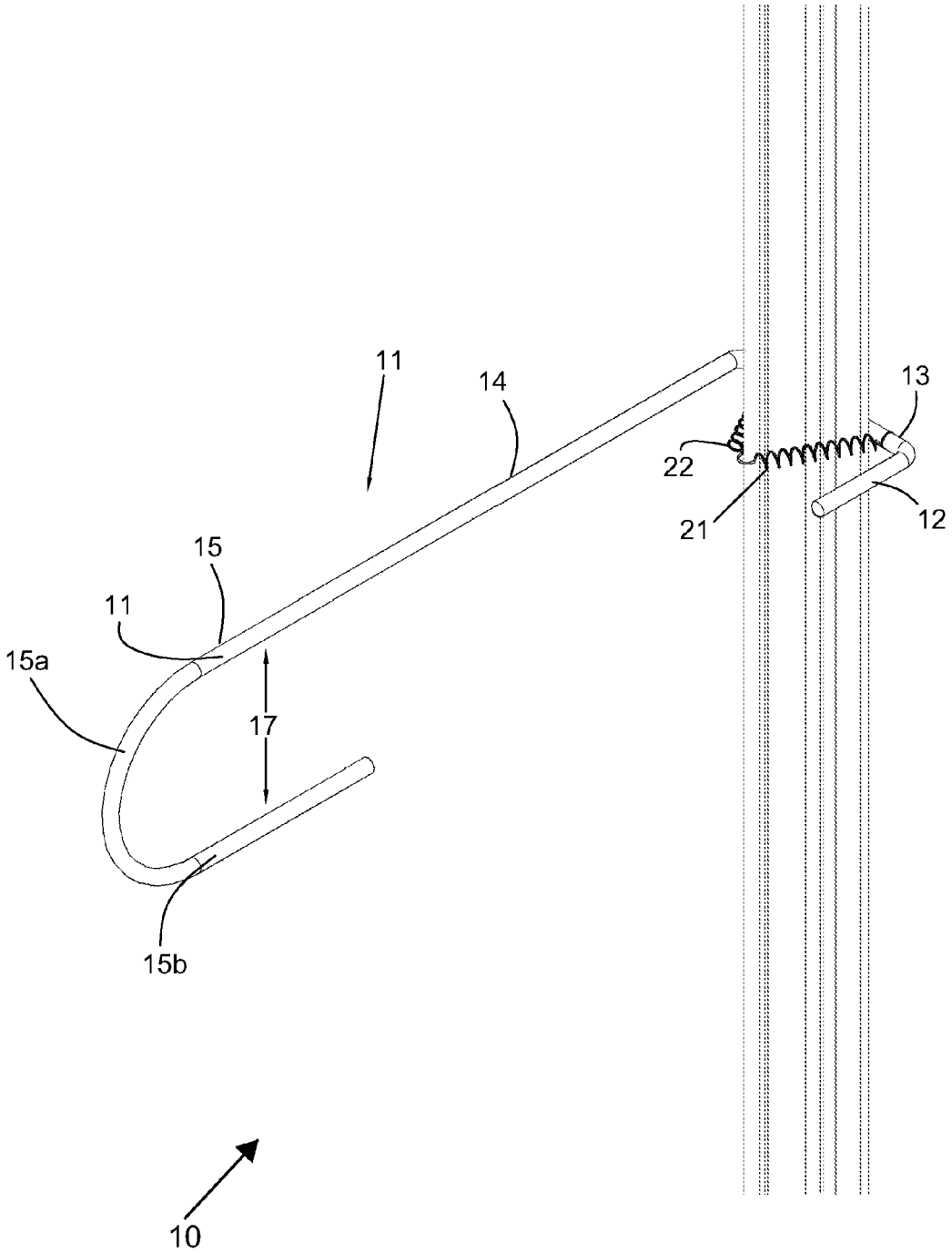
FIG. 6 shows a rear perspective view of the gate keeper of the embodiment of FIG. 1.
Figure 7:
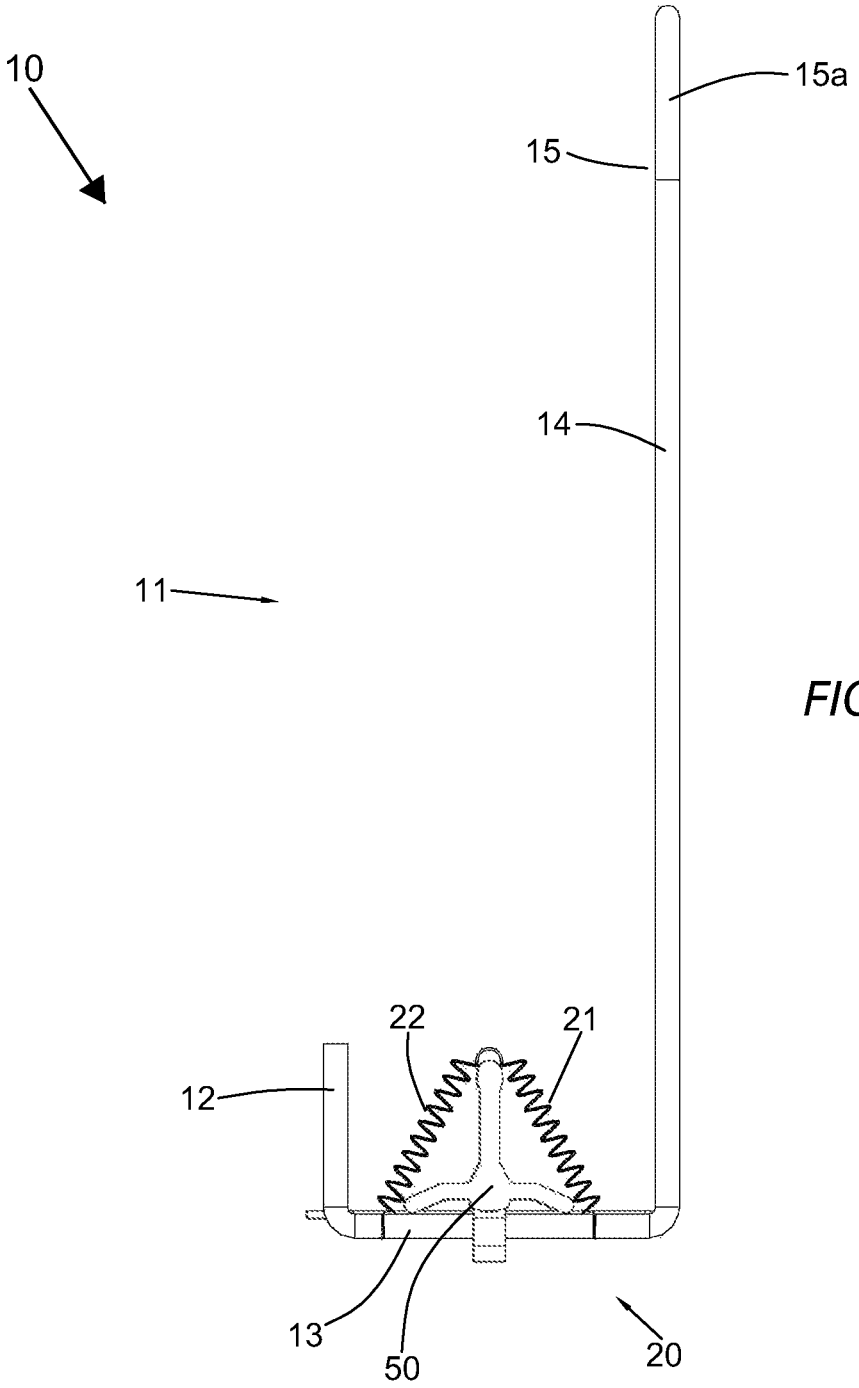
FIG. 7 shows a top view of the gate keeper of the embodiment of FIG. 1.

In accordance with FIG. 2, the gate latch 11 is secured against the T-post 50 at the base region 13 and rests between two studs 51 of the T-post 50. The gate latch 11 axially rotates about the base region 13, allowing the u-shaped 15 region to secure the gate rail 32, which is attached to the gate 31.

During operation, the height of the gate keeper 10 can be adjusted by adjusting the springs 21, 22 and moving the connector 20 and gate latch 11 in between differing studs 51 of the T-post 50. In an unlatched position, the gate latch 11 is axially rotated away from the gate rail 32. To secure the gate 31, then the gate latch 11 is axially rotated towards the gate rail 32, allowing the u-shaped region 15 to fit around the gate post 32 to a latched position. The advantage to the embodiment is that the height of the connector 20 can be adjusted by decompression of the springs 21, 22 around the studs 51 and T-post without having to remove the gate latch 11 from the connector 20.

Figure 16:
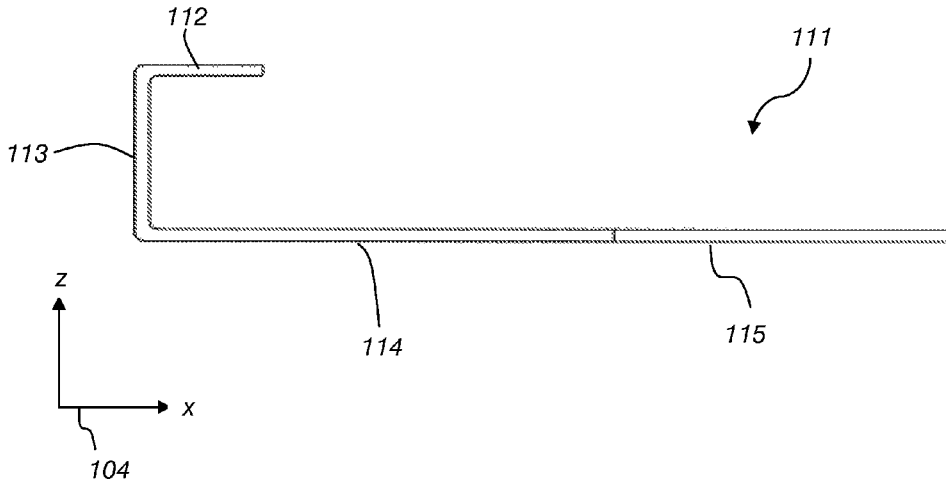
FIG. 16 shows a top view of the gate latch of the embodiment of FIG. 12.
Figure 17:
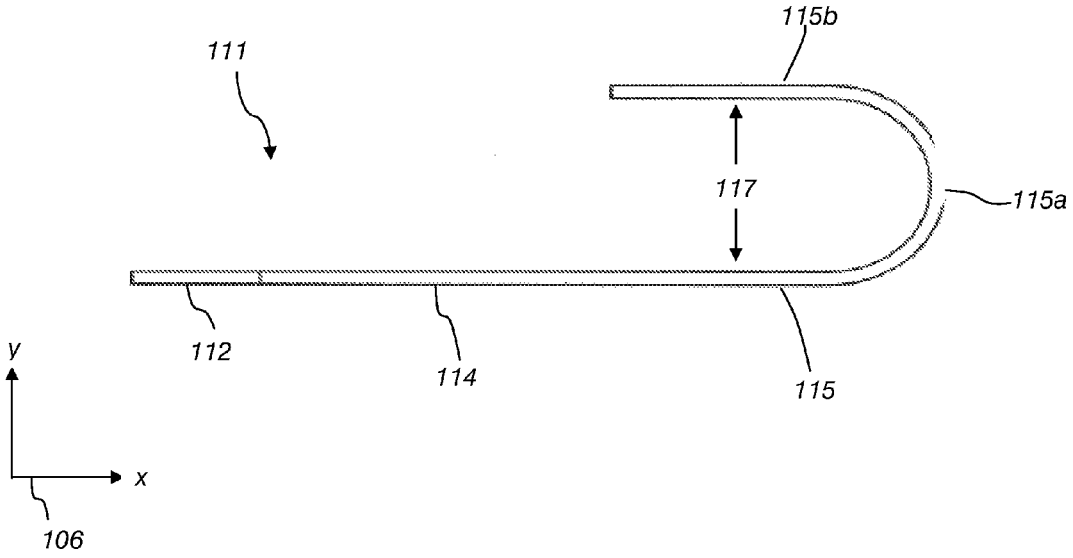
FIG. 17 shows a side view of the gate latch of the embodiment of FIG. 12.

A second embodiment is set forth in accordance with FIGS. 12-17. In the embodiment a gate keeper 110 comprises a gate latch 111 and connector 120. The gate latch 111 of the embodiment is similar to that of the first embodiment and comprises a latching region 112, a base region 113, an extending region 114 existing coplanar in a first plane 104, and a u-shaped region 115 extending in a second plane 106, as shown in FIGS. 16-17. The connector 120 is a square shaped bracket piece, with a pair of external apertures 125, 126 along a front surface of the connector 120, as shown in FIGS. 16-17. The connector 120 is inserted over a T-post 150 at a specific height from the ground. The gate latch 111 is inserted through the apertures 125, 126 as shown in FIGS. 13-15. Insertion of the gate latch 111 through the apertures 125, 126 secures the connector 120 between a pair of studs 151. The gate latch 111 is capable of axial rotation with respect to the connector 120 about the base region, thereby allowing the u-shaped region 115 to fit around a gate rail 132 attached to a gate 131.

Although the present invention has been described in considerable detail with reference to certain preferred versions thereof, other versions are possible. For example, the shape and material of the gate latch may vary. The u-shaped region may extend at different distances allowing accommodation for differing sizes of gates. The gate latch may also exist without a latching region. Moreover, the connector may comprise a single spring circumventing a T-post, or a plurality of springs. Therefore, the spirit and scope of the appended claims should not be limited to the descriptions of the preferred versions herein.

What is claimed is:

1. A gate keeper for latching a movable gate, the gate keeper comprising:

a gate latch constructed of a rigid length of material, the rigid length of material being bent such that the gate latch has a base region, an extending region, and a u-shaped region; and a connector which circumposes a T-post, wherein the connector retains the gate latch on the T-post between an adjacent pair of a plurality of studs arranged along an outer surface of the T-post, thereby permitting a relative position of the gate latch on the T-post to be varied, and the connector permits the gate latch to pivot on an axis perpendicular to a longitudinal axis of the T-post, thereby allowing the gate latch to latch around a horizontal rail of the movable gate.

2. The gate keeper of claim 1, wherein the relative position of the gate latch is varied without removal of the gate latch from the connector.

3. The gate keeper of claim 1, wherein the connector comprises a spring assembly.

4. The gate keeper of claim 1, wherein the spring assembly is attached to a base region of the gate latch.

5. The gate keeper of claim 1, wherein the spring assembly comprises first and second springs.

* * * * *